US011315488B2

(12) United States Patent
Xie

(10) Patent No.: US 11,315,488 B2
(45) Date of Patent: Apr. 26, 2022

(54) PIXEL COMPENSATION CIRCUIT, DRIVING METHOD, AND DISPLAY DEVICE

(71) Applicant: Wuhan China Star Optoelectronics Semiconductor Display Technology Co., Ltd., Wuhan (CN)

(72) Inventor: Yan Xie, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 85 days.

(21) Appl. No.: 16/631,487

(22) PCT Filed: May 17, 2019

(86) PCT No.: PCT/CN2019/087339
§ 371 (c)(1),
(2) Date: Jan. 16, 2020

(87) PCT Pub. No.: WO2020/220402
PCT Pub. Date: Nov. 5, 2020

(65) Prior Publication Data

US 2021/0241687 A1 Aug. 5, 2021

(30) Foreign Application Priority Data

Apr. 28, 2019 (CN) ..... 201910348314.3

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 3/3233; G09G 3/3266; G09G 3/3291; G09G 2300/0842; G09G 2320/045
See application file for complete search history.

(56) References Cited

U.S. PATENT DOCUMENTS

2020/0051491 A1 2/2020 Xuan et al.
2020/0226978 A1* 7/2020 Lin ..... H01L 27/3262

FOREIGN PATENT DOCUMENTS

CN 106991964 7/2017
CN 107180612 9/2017
(Continued)

*Primary Examiner* — Stacy Khoo

(57) ABSTRACT

A pixel compensation circuit is provided. The pixel compensation circuit includes: a first transistor connected to a first scan line, wherein a first terminal of the first transistor is connected to a data line and a second terminal of the first transistor is connected to a second terminal of the driving transistor; a second transistor connected to a first scan line, wherein a first terminal of the second transistor is connected to a first terminal of the driving transistor and a second terminal of the second transistor is connected to a control terminal of the driving transistor; and a third transistor, wherein a control terminal of the third transistor is connected to a control line, a first terminal of the third transistor is connected to a supply voltage line, and a second terminal of the third transistor is connected to the first terminal of the driving transistor.

2 Claims, 7 Drawing Sheets

(52) U.S. Cl.
CPC ..... *G09G 2300/0842* (2013.01); *G09G 2320/045* (2013.01)

(56) References Cited

FOREIGN PATENT DOCUMENTS

| | | |
|---|---|---|
| CN | 107610640 | 1/2018 |
| CN | 109064975 | 12/2018 |
| KR | 2010-0047505 | 5/2010 |

* cited by examiner

PIXEL COMPENSATION CIRCUIT, DRIVING METHOD, AND DISPLAY DEVICE

RELATED APPLICATIONS

This application is a National Phase of PCT Patent Application No. PCT/CN2019/087339 having International filing date of May 17, 2019, which claims the benefit of priority of Chinese Patent Application No. 201910348314.3 filed on Apr. 28, 2019. The contents of the above applications are all incorporated by reference as if fully set forth herein in their entirety.

FIELD AND BACKGROUND OF THE INVENTION

The present disclosure relates to a technical field of displays, and more particularly to a pixel compensation circuit, a driving method, and a display device.

As illustrated in FIG. 1, a basic driving circuit for an active-matrix organic light emitting diode (AMOLED) includes a switch transistor T1, a driving transistor T2, and a storage capacitor Cst. A driving current of an organic light emitting diode (OLED) is controlled by the driving transistor T2. An amount of the current of the OLED is expressed by $I_{OLED}=k\ (V_{gs}-V_{th})^2$, where k is a current amplification factor of the driving transistor T2 and is determined by characteristics of the driving transistor T2 itself, and Vth is a threshold voltage of the driving transistor T2.

However, because the threshold voltage of the driving transistor is prone to drift, causing the driving current of the OLED to change, an OLED panel becomes defective and image quality is affected.

SUMMARY OF INVENTION

Problems of the present disclosure are as follows. In an existing active-matrix organic light emitting diode (AMOLED) driving circuit, because a threshold voltage of a driving transistor is prone to drift, causing a driving current of an OLED to change, an OLED panel becomes defective and image quality is affected.

Technical solutions of the present disclosure are as follows. A pixel compensation circuit, includes:

a light-emitting element, wherein a first terminal of the light-emitting element is connected to a common voltage line;

a driving transistor configured to drive the light-emitting element to emit light;

a first transistor, wherein a control terminal of the first transistor is connected to a first scan line, a first terminal of the first transistor is connected to a data line, and a second terminal of the first transistor is connected to a second terminal of the driving transistor;

a second transistor, wherein a control terminal of the second transistor is connected to the first scan line, a first terminal of the second transistor is connected to a first terminal of the driving transistor, and a second terminal of the second transistor is connected to a control terminal of the driving transistor;

a third transistor, wherein a control terminal of the third transistor is connected to a control line, a first terminal of the third transistor is connected to a supply voltage line, a second terminal of the third transistor is connected to the first terminal of the driving transistor;

a fourth transistor, wherein a control terminal of the fourth transistor is connected to the control line, a first terminal of the fourth transistor is connected to the second terminal of the driving transistor, and a second terminal of the fourth transistor is connected to a second terminal of the light-emitting element;

and a storage capacitor, wherein a first terminal of the storage capacitor is connected to the supply voltage line, a second terminal of the storage capacitor, the second terminal of the second transistor, and the control terminal of the driving transistor are connected to a third node.

Further, the pixel compensation circuit further includes a fifth transistor, wherein a control terminal of the fifth transistor is connected to a second scan line, the second scan line provides a second scan signal to the control terminal of the fifth transistor, and the fifth transistor is configured to be turned on under control of the second scan signal to pull down an electric potential at the control terminal of the driving transistor to a low electric potential.

Further, a first terminal of the fifth transistor is connected to a first reset voltage line, and a second terminal of the fifth transistor is connected to the control terminal of the driving transistor.

Further, the pixel compensation circuit further includes a sixth transistor, wherein a control terminal of the sixth transistor is connected to a third scan line, the third scan line provides a third scan signal to the sixth transistor, and the sixth transistor is configured to be turned on under control of the third scan signal to pull down an electric potential at the second terminal of the light-emitting element to a low electric potential.

Further, a first terminal of the sixth transistor is connected to a second reset line, and a second terminal of the sixth transistor is connected to the second terminal of the light-emitting element.

Further, a supply voltage provided by the supply voltage line is larger than a common voltage provided by the common voltage line.

Further, the first transistor, the second transistor, the third transistor, the fourth transistor, the fifth transistor, the sixth transistor, and the driving transistor are all thin film field effect transistors.

A driving method for a pixel compensation circuit, includes:

in a first stage, turning on a fifth transistor and a sixth transistor, turning off a first transistor, a second transistor, a third transistor, a fourth transistor, and a driving transistor, resetting a control terminal of the driving transistor to a first reset voltage, and resetting a second terminal of a light-emitting element to a second reset voltage;

in a second stage, turning on the first transistor, the second transistor, and the driving transistor, turning off the fifth transistor and the sixth transistor, and providing a data signal voltage to a first terminal of the first transistor through a data line, wherein at this time, a voltage at the control terminal of the driving transistor is a sum of the data signal voltage and a threshold voltage of the driving transistor, and a voltage stored by the storage capacitor is equal to the threshold voltage of the driving transistor; and in a third stage, turning on the third transistor and the fourth transistor, turning off the first transistor and the second transistor, and driving the light-emitting element to emit light by the driving transistor.

Further, when a first scan signal provided by a first scan line is at a low level, the first transistor and the second transistor are controlled to be turned on, and when the first scan signal is at a high level, and the first transistor and the second transistor are controlled to be turned off;

when a control signal provided by a control line is at a low level, the third transistor and fourth transistor are controlled to be turned on, and when the control signal is at a high level, the third transistor and the fourth transistor are controlled to be turned off;

when a second scan signal is at a low level, the fifth transistor is controlled to be turned on, and when the second scan signal is at a high level, the fifth transistor is controlled to be turned off; and when a third scan signal is at a low level, the sixth transistor is controlled to be turned on, and when the third scan signal is at a high level, the sixth transistor is controlled to be turned off.

A display device, includes:

a plurality of pixel units, wherein each of the pixel units includes any one of the aforementioned pixel compensation circuits;

a scan driving circuit configured to provide a scan signal for the pixel compensation circuit;

a data driving circuit configured to provide a data signal voltage for the pixel compensation circuit; and a control driving circuit configured a control signal for the pixel compensation circuit.

Advantages of a touch panel and a fabrication method thereof are as follows. During a light emission stage, a current flowing through a light-emitting element has no relationship with a threshold voltage of a driving transistor, thereby eliminating an impact of the threshold voltage of the driving transistor on the current flowing through the light-emitting element. Also, during a reset stage, an anode of the light-emitting element is reset using a second reset voltage, thereby causing the anode to be at a lower electric potential, contributing to dark state luminance reduction, increasing contrast, and extending life of the light-emitting element.

BRIEF DESCRIPTION OF THE SEVERAL VIEWS OF THE DRAWINGS

In order to describe a technical solution in embodiments or existing technology more clearly, drawings required to be used by the embodiments are briefly introduced below. Obviously, the drawings in the description below are only some embodiments of the present disclosure. With respect to persons of ordinary skill in the art, under a premise that inventive efforts are not made, other drawings may be obtained based on these drawings.

DESCRIPTION OF SPECIFIC EMBODIMENTS OF THE INVENTION

Figure 1:
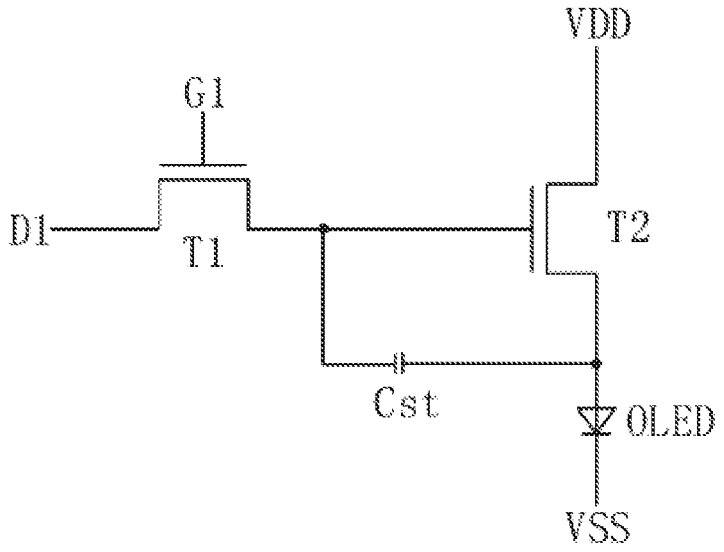
FIG. 1 PRIOR ART
FIG. 1 is a schematic structural diagram of a basic driving circuit for an active-matrix organic light emitting diode (AMOLED) of a background art of the present disclosure.

The description of each embodiment below refers to respective accompanying drawing(s), to illustrate exemplarily specific embodiments of the present disclosure that may be practiced. Directional terms mentioned in the present disclosure, such as "upper", "lower", "front", "back", "left", "right", "inner", "outer", "side", etc., are only directions by referring to the accompanying drawings, and thus the used directional terms are used to describe and understand the present disclosure, but the present disclosure is not limited thereto. In the drawings, structurally similar units are labeled by the same reference numerals.

In the present disclosure, with respect to a technical problem that in an existing pixel driving circuit, because a threshold voltage of a driving transistor DT is prone to drift, causing a driving current of an organic light emitting diode (OLED) to change, an OLED panel becomes defective, a solution is provided.

Figure 2:
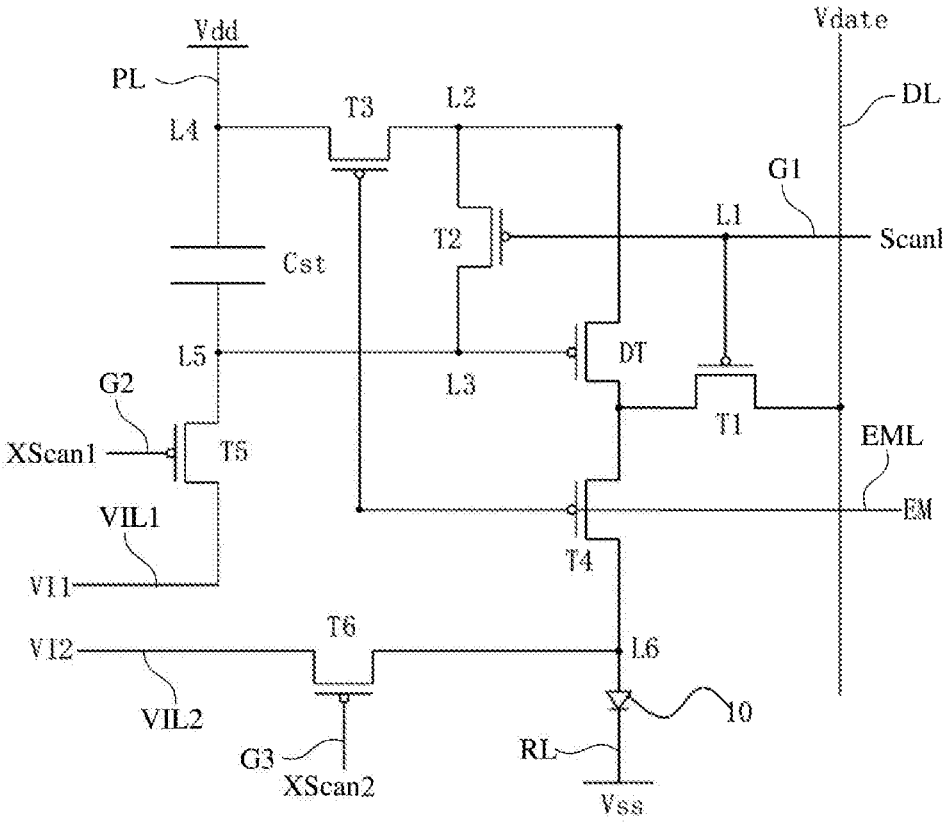
FIG. 2 is a schematic structural diagram of a pixel compensation circuit in accordance with a specific embodiment of the present disclosure.
Figure 3:
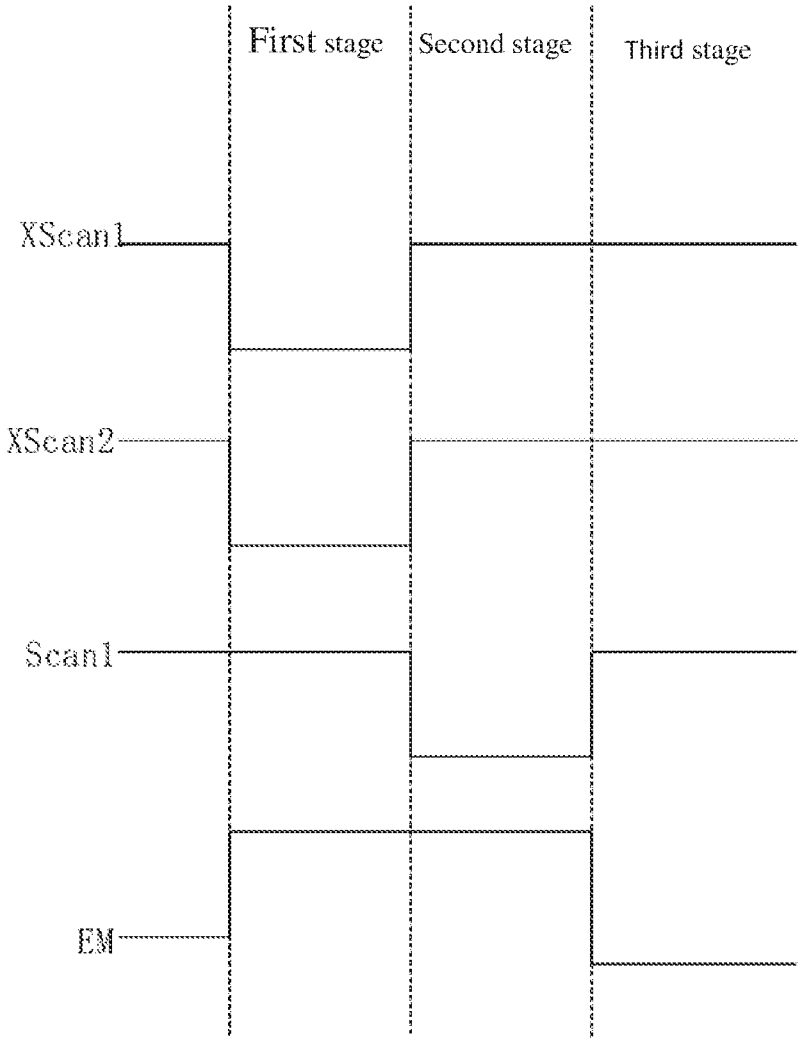
FIG. 3 is a waveform timing diagram of the pixel compensation circuit in accordance with a specific embodiment of the present disclosure.

FIG. 2 illustrates a pixel compensation circuit. The pixel compensation circuit includes a light-emitting element 10, a driving transistor DT, a first transistor T1, a second transistor T2, a third transistor T3, a fourth transistor T4, and a storage capacitor Cst.

The light-emitting element 10 is an OLED. A first terminal of the light-emitting element 10 is connected to a common voltage line RL. The common voltage line RL provides a common voltage Vss to the first terminal of the light-emitting element 10. The common voltage line RL is generally a ground voltage line.

The driving transistor DT is configured to drive the light-emitting element 10 to emit light.

The first transistor T1 has a control terminal connected to a first scan line G1, a first terminal connected to a data line DL, and a second terminal connected to a second terminal of the driving transistor DT.

The data line DL provides a data signal voltage Vdate to the second terminal of the first transistor T1.

The second transistor T2 has a control terminal connected to the first scan line G1, a first terminal connected to a first terminal of the driving transistor DT, and a second terminal connected to a control terminal of the driving transistor DT. The control terminal of the second transistor T2, the control terminal of the first transistor T1, and the first scan line G1 are connected to a first node L1.

The first scan line G1 provides a first scan signal Scan1 to the control terminal of the first transistor T1 and the control terminal of the second transistor T2.

The third transistor T3 has a control terminal connected to the control line EML, a first terminal connected to a supply voltage line PL, a second terminal connected to the first terminal of the driving transistor DT. The first terminal of the second transistor T2, the second terminal of the third transistor T3, and the first terminal of the driving transistor DT are connected to a second node L2.

The supply voltage line PL provides a supply voltage Vdd, and the supply voltage Vdd is larger than the common voltage Vss.

The fourth transistor T4 has a control terminal connected to the control line EML, a first terminal connected to the second terminal of the driving transistor DT, and a second terminal connected to a second terminal of the light-emitting element 10. The control line EML provides a control signal EM.

The storage capacitor Cst has a first terminal connected to the supply voltage line PL. A second terminal of the storage capacitor Cst, the second terminal of the second transistor T2, and the control terminal of the driving transistor DT are connected to a third node L3. The first terminal of the storage capacitor Cst, the supply voltage line PL, and the first terminal of the third transistor T3 are connected to a fourth node L4.

Specifically, the pixel compensation circuit further includes a fifth transistor T5. A control terminal of the fifth transistor T5 is connected to a second scan line G2. The second scan line G2 provides a second scan signal XScan1 to the control terminal of the fifth transistor T5. The fifth transistor T5 is configured to be turned on under control of the second scan signal XScan1 to pull down an electric potential at the control terminal of the driving transistor DT to a low electric potential.

A first terminal of the fifth transistor T5 is connected to a first reset voltage line VIL1. A second terminal of the fifth transistor T5, the control terminal of the driving transistor DT, and the second terminal of the storage capacitor Cst are connected to a fifth node L5. The first reset voltage line VIL1 provides a first reset voltage VI1 The first reset voltage VI1 is a low voltage.

Specifically, the pixel compensation circuit further includes a sixth transistor T6. A control terminal of the sixth transistor T6 is connected to a third scan line G3. The third scan line G3 provides a third scan signal XScan2 to the sixth transistor T6. The sixth transistor T6 is configured to be turned on under control of the third scan signal XScan2 to pull down an electric potential at the second terminal of the light-emitting element 10 to a low electric potential.

A first terminal of the sixth transistor T6 is connected to a second reset line VIL2. A second terminal of the sixth transistor T6, the second terminal of the light-emitting element 10, and the second terminal of the fourth transistor T4 are connected to a sixth node L6. The second reset line VIL2 provides a second reset voltage VI2. The second reset voltage VI2 is a low voltage.

The first transistor T1, the second transistor T2, the third transistor T3, the fourth transistor T4, the fifth transistor T5, the sixth transistor T6, and the driving transistor DT are all thin film field effect transistors.

It is to be noted that the first terminal of the light-emitting element 10 is a cathode, and the second terminal of the light-emitting element 10 is an anode. Each of the first terminals of the first transistor T1, the second transistor T2, the third transistor T3, the fourth transistor T4, the fifth transistor T5, the sixth transistor T6, and the driving transistor DT may be a source of a transistor, or may be a drain of the transistor.

Based on the aforementioned pixel compensation circuit, the present disclosure also provides a driving method for the pixel compensation circuit. Referring to FIGS. 3 to 6, the driving method for the pixel compensation circuit includes three stages.

When the first scan line G1 provided by the first scan line Scan1 is at a low level, the first transistor T1 and the second transistor T2 are controlled to be turned on, and when the first scan signal Scan1 is at a high level, and the first transistor T1 and the second transistor T2 are controlled to be turned off.

When the control signal EM provided by the control line EML is at a low level, the third transistor T3 and fourth transistor T4 are controlled to be turned on, and when the control signal EM is at a high level, the third transistor T3 and the fourth transistor T4 are controlled to be turned off.

When the second scan signal XScan1 is at a low level, the fifth transistor T5 is controlled to be turned on, and when the second scan signal XScan1 is at a high level, the fifth transistor T5 is controlled to be turned off.

When the third scan signal XScan2 is at a low level, the sixth transistor T6 is controlled to be turned on, and when the third scan signal XScan2 is at a high level, the sixth transistor T6 is controlled to be turned off.

Figure 4:
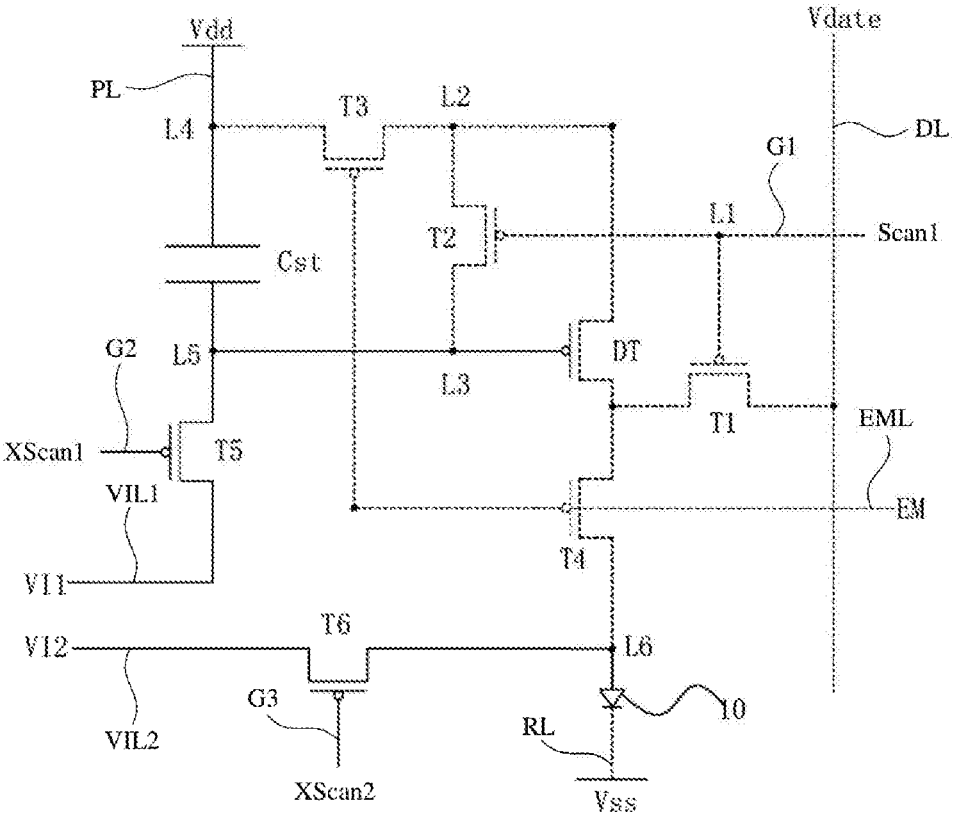
FIG. 4 is a schematic diagram of an equivalent structure of the pixel compensation circuit when a pixel is in a reset stage in accordance with a specific embodiment of the present disclosure.

Specifically, as illustrated in FIG. 4, in a first stage, the second scan signal XScan1 is at a low level, the third scan signal XScan2 is at a low level, the first scan signal Scan1 is at a high level, and the control signal EM is at a high level.

At this time, the fifth transistor T5 and the sixth transistor T6 are turned on. At the same time, the first transistor T1, the second transistor T2, the third transistor T3, the fourth transistor T4, and the driving transistor DT are turned off. The control terminal of the driving transistor DT electrically connected to the first reset voltage line VIL1 is reset to the first reset voltage VI1. The second terminal of the light-emitting element 10 electrically connected to the second reset line VIL2 is reset to the second reset voltage VI2. This stage is a reset stage of a pixel.

Figure 5:
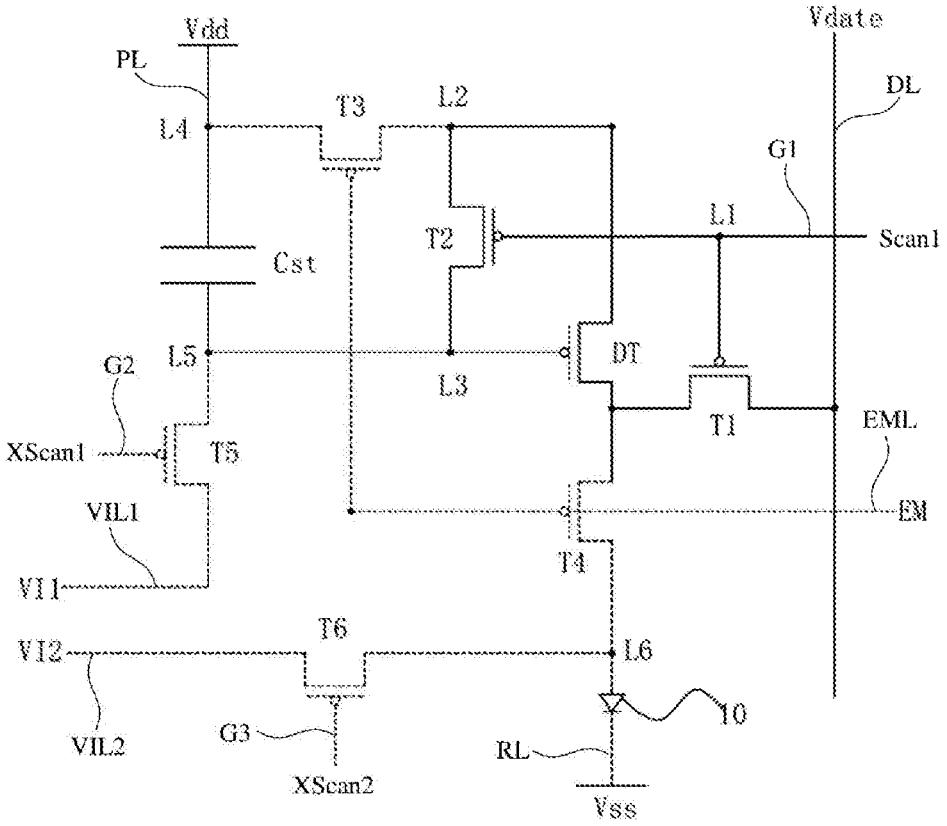
FIG. 5 is a schematic diagram of an equivalent structure of the pixel compensation circuit when the pixel is in a compensation stage in accordance with a specific embodiment of the present disclosure.

In a second stage, as illustrated in FIG. 5, at this time, the second scan signal XScan1 is pulled up to be at a high level, the third scan signal XScan2 is pulled up to be at a high level, the first scan signal Scan1 is pulled down to be at a low level, and the control signal EM is maintained at the high level.

At this time, the first transistor T1, the second transistor T2, and the driving transistor DT are turned on. The fifth transistor T5 and the sixth transistor T6 are turned off. The third transistor T3 and the fourth transistor T4 are maintained in an OFF state. The data line DL provides the data signal voltage Vdate to the first terminal of the first transistor T1. A threshold voltage Vth of the driving transistor DT is stored by the storage capacitor Cst. That is, a voltage stored by the storage capacitor Cst is equal to the threshold voltage Vth of the driving transistor DT. At this time, a voltage at the control terminal of the driving transistor DT is a sum of the data signal voltage Vdate and the threshold voltage Vth of the driving transistor DT. This stage is a compensation stage of the pixel.

Figure 6:
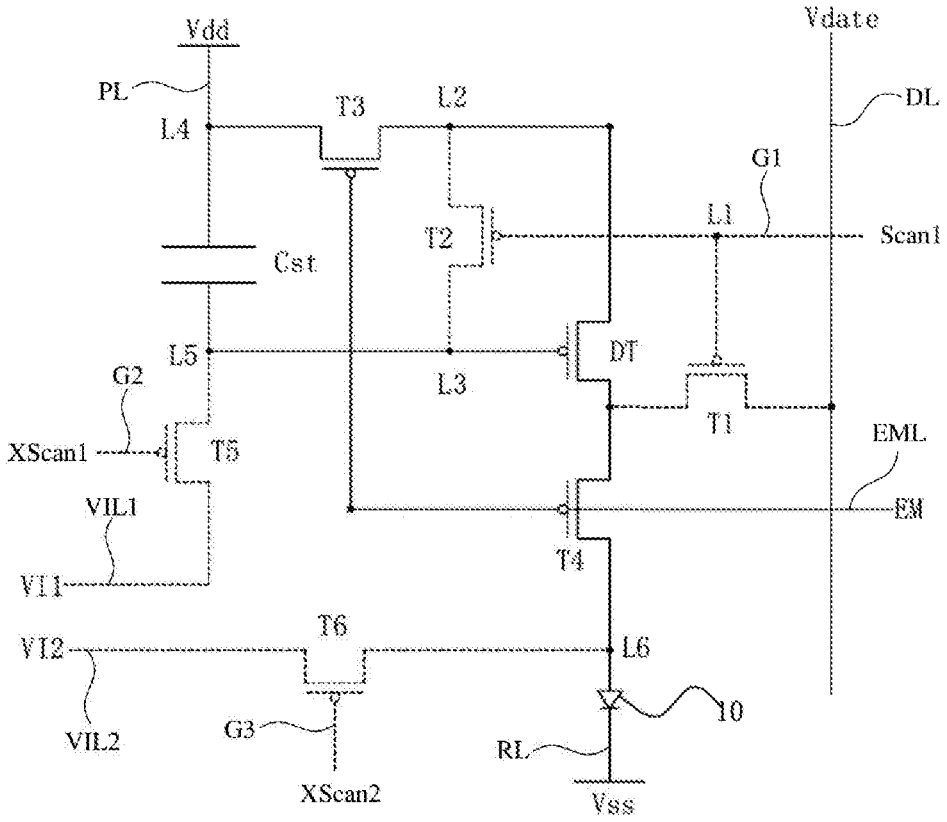
FIG. 6 is a schematic diagram of an equivalent structure of the pixel compensation circuit when the pixel is in a light emission stage in accordance with a specific embodiment of the present disclosure.

In a third stage, as illustrated in FIG. 6, the second scan signal XScan1 is maintained at the high level, the third scan signal XScan2 is maintained at the high level, the first scan signal Scan1 is pulled up to be at the high level, and the control signal EM is pulled down to be at a low level.

At this time, the third transistor T3 and the fourth transistor T4 are turned on. The first transistor T1 and the second transistor T2 are turned off. The fifth transistor T5 and the sixth transistor T6 are maintained in the OFF state. The driving transistor DT is in an ON state. The storage capacitor Cst maintains a voltage difference in the second stage. At this time, the driving transistor DT, the fourth transistor T4, and the light-emitting element 10 are in a series-connected conducting path. The driving transistor DT drives the light-emitting element 10 to emit light. This stage is a light emission stage of the pixel.

It is to be noted that in FIGS. 4 to 6, dotted line portions represent nonconducting paths, and solid line portions represent conducting paths.

It can be known to persons skilled in the art that in the light emission stage, an amount of current flowing through the light-emitting element 10 is expressed by $I_{OLED}$=K $(Vgs-Vth)^2$. At this time, Vgs=Vdate+Vth−Vdd. That is, at this time, $I_{OLED}=K(Vdate-Vdd)^2$, where k is twice a current amplification factor of the driving transistor DT and is determined by characteristics of the driving transistor DT itself. It can be known that the current $I_{OLED}$ flowing through the light-emitting element 10 is only related to the data signal voltage Vdate and the supply voltage Vdd, and is not related to the threshold voltage Vth of the driving transistor DT. Therefore, an impact of the threshold voltage Vth of the driving transistor DT on the current $I_{OLED}$ flowing through the light-emitting element 10 is eliminated.

Figure 7:
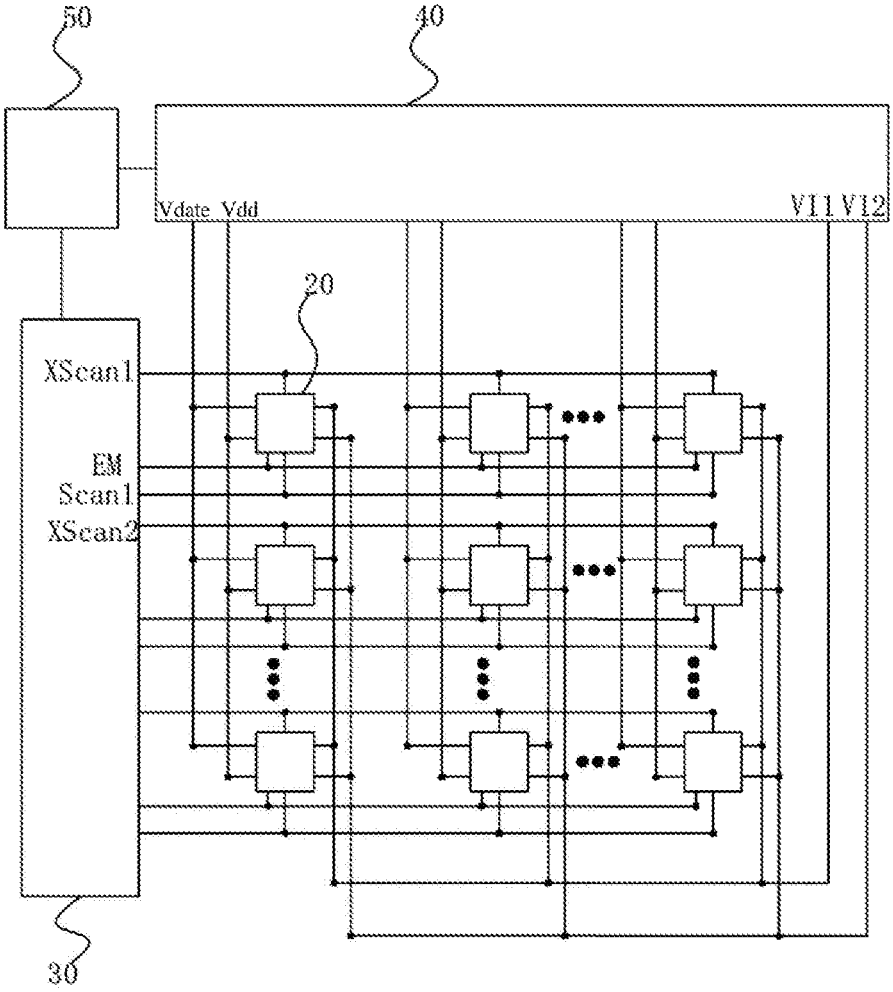
FIG. 7 is a schematic structural diagram of a display device in accordance with a specific embodiment of the present disclosure.

Based on the aforementioned pixel compensation circuit, the present disclosure also provides a display device. As illustrated in FIG. 7, the display device includes a plurality of pixel units 20, a scan driving circuit 30, a data driving circuit 40, and a control driving circuit 50.

Each of the pixel units 20 includes the aforementioned pixel compensation circuit.

The scan driving circuit 30 is configured to provide a plurality of scan signals Scan1, XScan1, and XScan2 for the pixel compensation circuit.

The data driving circuit 40 is configured to provide a data signal voltage Vdate and a supply voltage Vdd for the pixel compensation circuit.

The control driving circuit 50 is configured a control signal EM for the pixel compensation circuit.

Advantageous effects of the present disclosure: During a light emission stage, a current $I_{OLED}$ flowing through a light-emitting element 10 has no relationship with a threshold voltage Vth of a driving transistor DT, thereby eliminating an impact of the threshold voltage Vth of the driving transistor DT on the current $I_{OLED}$ flowing through the light-emitting element 10. Also, during a reset stage, an anode of the light-emitting element 10 is reset using a second reset voltage VI2, thereby causing the anode to be at a lower electric potential, contributing to dark state luminance reduction, increasing contrast, and extending life of the light-emitting element 10.

In summary, although the present disclosure has been described with preferred embodiments thereof above, it is not intended to be limited by the foregoing preferred embodiments. Persons skilled in the art can carry out many changes and modifications to the described embodiments without departing from the scope and the spirit of the present disclosure. Therefore, the protection scope of the present disclosure is in accordance with the scope defined by the claims.

What is claimed is:

1. A driving method for a pixel compensation circuit, comprising:

at a first stage, turning on a fifth transistor and a sixth transistor, turning off a first transistor, a second transistor, a third transistor, a fourth transistor, and a driving transistor, resetting a control terminal of the driving transistor to a first reset voltage, and resetting a second terminal of a light-emitting element to a second reset voltage;

at a second stage, turning on the first transistor, the second transistor, and the driving transistor, turning off the fifth transistor and the sixth transistor, and providing a data signal voltage to a first terminal of the first transistor through a data line, wherein at this time, a voltage at the control terminal of the driving transistor is a sum of the data signal voltage and a threshold voltage of the driving transistor, and a voltage stored by the storage capacitor is equal to the threshold voltage of the driving transistor; and at a third stage, turning on the third transistor and the fourth transistor, turning off the first transistor and the second transistor, and driving the light-emitting element to emit light by the driving transistor.

2. The driving method for the pixel compensation circuit of claim 1, wherein when a first scan signal provided by a first scan line is at a low level, the first transistor and the second transistor are controlled to be turned on, and when the first scan signal is at a high level, and the first transistor and the second transistor are controlled to be turned off;

when a control signal provided by a control line is at a low level, the third transistor and fourth transistor are controlled to be turned on, and when the control signal is at a high level, the third transistor and the fourth transistor are controlled to be turned off;

when a second scan signal is at a low level, the fifth transistor is controlled to be turned on, and when the second scan signal is at a high level, the fifth transistor is controlled to be turned off; and when a third scan signal is at a low level, the sixth transistor is controlled to be turned on, and when the third scan signal is at a high level, the sixth transistor is controlled to be turned off.

* * * * *